United States Patent [19]

Matsui et al.

[11] Patent Number: 4,790,531

[45] Date of Patent: Dec. 13, 1988

[54] INDOOR SKI SLOPE AND APPARATUS FOR MAKING SNOW THEREON

[75] Inventors: Nobuyuki Matsui; Shinichi Yokota; Kazuo Otsuka; Shuhei Mizote; Tadashi Yoshida; Hachiro Nonaka; Tsutomu Okumura, all of Tokyo, Japan

[73] Assignee: Kajima Corporation, Tokyo, Japan

[21] Appl. No.: 932,869

[22] Filed: Nov. 18, 1986

[30] Foreign Application Priority Data

| | | | |
|---|---|---|---|
| Nov. 19, 1985 | [JP] | Japan | 60-259594 |
| Apr. 18, 1986 | [JP] | Japan | 61-89627 |
| May 20, 1986 | [JP] | Japan | 61-115712 |
| Jun. 18, 1986 | [JP] | Japan | 61-142318 |

[51] Int. Cl.[4] ..... A63G 21/00

[52] U.S. Cl. ..... 272/565 SS; 52/187; 446/168; 239/2.2; 238/10 R

[58] Field of Search ..... 272/56.5 R, 56.5 S; 280/806; 52/187; 446/168, 170; 239/2.2; 238/10 R, 10 E

[56] References Cited

U.S. PATENT DOCUMENTS

| | | | |
|---|---|---|---|
| 1,252,158 | 1/1918 | Okel | 446/168 |
| 1,754,375 | 4/1930 | Sturges | 272/56.5 R X |
| 2,838,870 | 6/1958 | Morse | 446/168 X |
| 3,250,530 | 5/1966 | Dean et al. | 272/56.5 S |
| 3,468,087 | 9/1969 | Stancliffe | 52/187 |
| 3,513,906 | 5/1970 | Richards | 239/2.2 X |
| 3,814,418 | 6/1974 | Henning | 272/56.5 R |
| 4,035,970 | 7/1977 | Welcker | 52/187 |
| 4,171,090 | 10/1979 | Eisenburg | 446/168 X |
| 4,175,665 | 11/1979 | Dogliotti | 446/168 X |

FOREIGN PATENT DOCUMENTS

| | | | |
|---|---|---|---|
| 109999 | 3/1944 | Sweden | 52/187 |

OTHER PUBLICATIONS

Advertisement for "The Twister" to Amusement Business, Mar. 24, 1984, p. 14.

*Primary Examiner*—Richard J. Apley
*Assistant Examiner*—Robert D. Bahr
*Attorney, Agent, or Firm*—James H. Tilberry

[57] ABSTRACT

A structure is provided for indoor skiing on artificially made snow. The structure is thermally insulated and contains one or more support towers about which serpentine configured ski ramps are secured to provide relatively long ski run descents for relatively little lateral travel. For snow-making purposes, a small portion of the ski ramp is enclosed with a thermally insulated cubical module having a top and four sides but no floor. The module is track-mounted and self-propelled for movement along the ski ramp and means are provided to reduce the temperature within the module to snow-making temperature. Self-propelled snow-making machines are placed within the module to move down the ski ramp at the same rate of speed as the module. Skiing conditions encountered on outdoor ski slopes are simulated on the indoor ski ramps.

33 Claims, 11 Drawing Sheets

INDOOR SKI SLOPE AND APPARATUS FOR MAKING SNOW THEREON

BACKGROUND OF THE INVENTION

Various artificial ski slopes, both indoor and outdoor, have been proposed heretofore. However, the lengths of runs of prior art ski slopes have been limited by the lineal amount of subjacent land available upon which the slopes have been erected. This limitation has resulted in very short and unchallenging runs. Even a precipitous angle of slope would only yield a slight increase in length of run. Furthermore, an outdoor artificial slope has little or no advantage over a natural slope, since both require favorable weather conditions for snow-making. On the other hand, in order for artificial snow to be made for indoor slopes, substantially the entire containment building must be artificially cooled to snow-making temperature, resulting in high energy costs.

SUMMARY OF THE INVENTION

The subject invention not only solves the problem of limited subjacent land upon which to erect an artificial ski slope, but also solves the problem of the cost of producing artificial snow for the slope. These two problems are solved, in a preferred embodiment of the invention, by erecting a columnar support tower on a relatively small subjacent land base about which a ski run is mounted. Thus, in view of the well-known geometry of the helix, whatever land base area is required for the columnar support, the helical run can be designed to extend in length multiples of the height of the support tower and an even greater percentage of the length of the land base. The run can be further proportionately lengthened by erecting a pair of support towers about which a "figure eight" run configuration can be secured.

In order to render the containment building thermally efficient, the support tower may be erected in an excavated area substantially as deep as the tower is tall and then back-filled. The tower can then be capped off with a ski lodge at the top of the tower. In colder climates, the containment building may be cost-effectively insulated without the expense of first providing an excavation. In this embodiment of the invention, the support tower and containment building are erected at ground level.

Irrespective of whether the containment building is erected at ground level or is placed in an excavated pit and then back-filled, it would still be uneconomical to reduce the entire inside atmosphere of the containment building to a temperature conducive to snow-making.

Accordingly, another novel feature of this invention is the provision of a traveling snow-making cubical module. This module is track-mounted to extend from side to side of the slope and to encompass a delimited enclosed rectangular area of the slope. Thus contained, it is relatively inexpensive to reduce the atmosphere in this cubical module to snow-making temperature. Mobile snow-making equipment may then be placed within the cubical module. As snow is being manufactured, both the module and the mobile snow-making equipment are slowly advanced down the slope until the entire slope is snow-covered. Several spaced-apart snow-making modules may be used simultaneously in order to expedite the snow-making process. Special track accessories enable the module to negotiate tight turns of the track about the tower.

In order to simulate actual outdoor skiing conditions, provisions are made to vary the steepness of the slope from place to place. In addition, facilities are provided to produce random simulated moguls or an entire mogul field. Thus, during one run of the slope, most, if not all, of the conditions encountered on natural outdoor slopes may be simulated and incorporated into the run. Furthermore, these conditions may be easily modified at will to accommodate the skill levels of the skiers patronizing the facility.

OBJECTS OF THE INVENTION

It is therefore among the objects of the invention to: provide an indoor skiing facility in which artificial snow can be economically and efficiently made; provide an indoor skiing facility having one or more ski ramps of exceptional length in relation to the length of the land base upon which the facility is erected; provide a skiing facility erected in an excavation and then back-filled for thermal efficiency; provide a skiing facility having at least one central support tower about which a ski ramp is helically suspended; provide a skiing facility having a pair of support towers about which one or more ski ramps are interconnected; provide a skiing facility in which any portion of the ski ramp may be adjusted at will; provide a skiing facility in which the containment building comprises a central columnar tower from which cantilevered top support beams cable suspend ski ramp support beams and means to adjust the cable to change the spatial positions of said beams; provide a skiing facility with shiftable ski ramp floor support joists adapted to enable the slope of the ski ramp floor to be adjusted; provide a skiing facility having fluid-mechanical means to simulate moguls at selectable places on the ski ramp; provide a skiing facility having fluid-mechanical means to make adjustable moguls; provide a self-powered track-supported mobile snow-making module adapted to move down the ramp and to coat the ramp with artificial snow; and provide means to permit track-mounted snow-making modules to negotiate tight turns of the track about the ski ramp support tower.

The foregoing and other objects, features, and advantages of the invention will become apparent from the description set forth hereinafter when considered in conjunction with the accompanying drawings.

DETAILED DESCRIPTION OF PREFERRED EMBODIMENTS OF THE INVENTION

Figure 1:
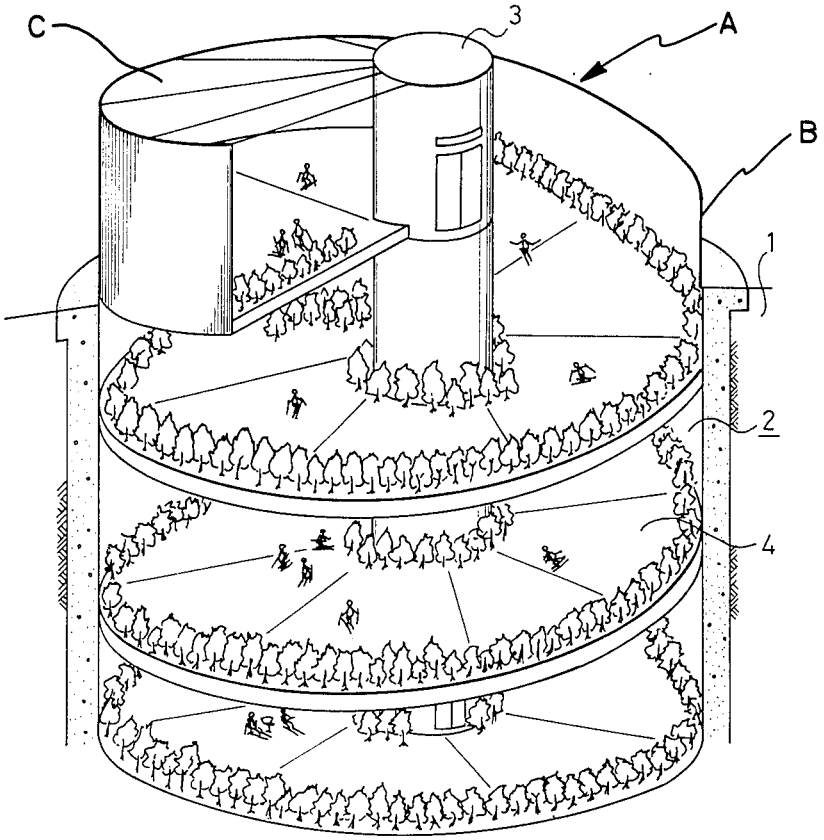
FIG. 1 is a perspective view, partially in section, of a preferred embodiment of the invention showing an indoor skiing coliseum having a helical ski ramp around a columnar support tower.

FIG. 1 shows a preferred embodiment of the indoor skiing coliseum A according to the present invention. The coliseum A comprises a containment building B constructed in an excavated pit 2 and back-filled by excavated ground 1. The upper portion of the containment building is capped by either a roof C or a superstructure such as a ski lodge and/or an office space.

In any event, the containment building B is totally enclosed and thermally insulated. Centered in the containment building B is a columnar support tower 3. A helically descending ski ramp 4 is secured to and supported by the support tower 3. The support tower 3 is a hollow cylindrical body made of steel or concrete of sufficient diameter to accommodate an elevator of adequate capacity to transport skiers from the bottom to the top of the ramp.

Figure 2:
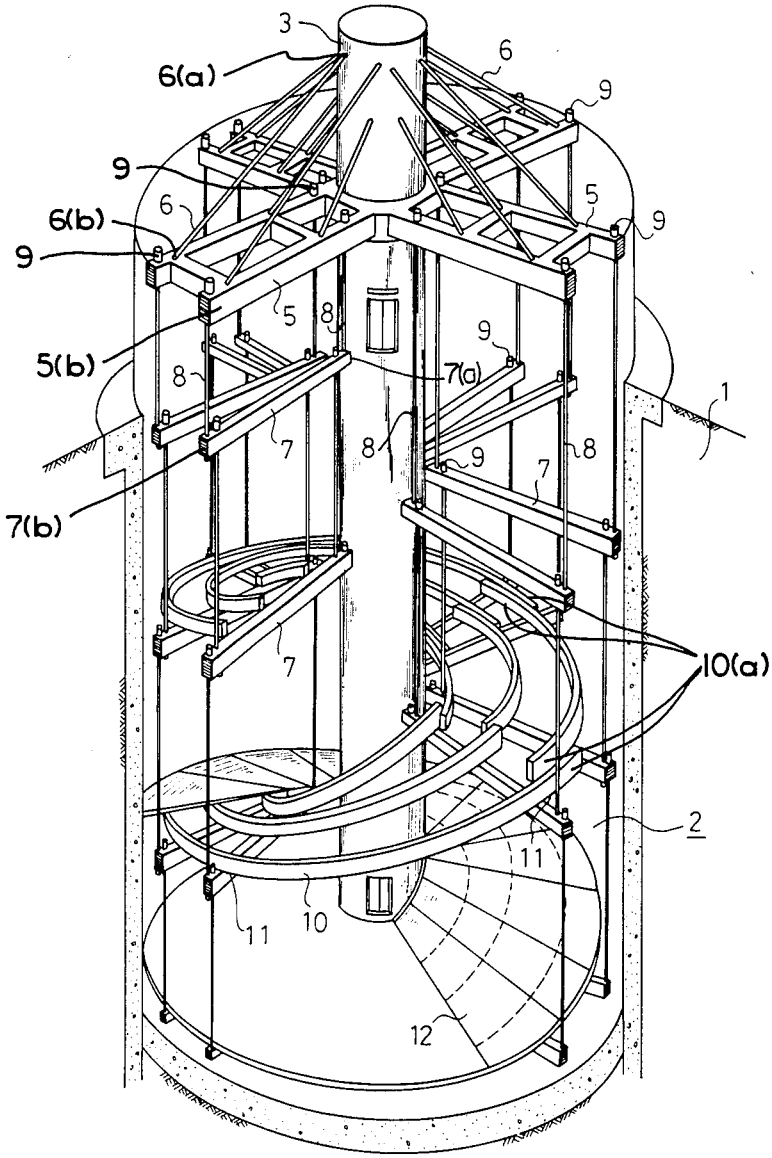
FIG. 2 is a perspective view, partially in section, of another preferred embodiment of the invention showing the supporting framework of the ski ramp illustrated in FIG. 1.

FIG. 2 shows the structural members of the containment building B shown in FIG. 1. The support tower 3 is erected from the center of the bottom of the pit 2 such that it projects above ground level. The top of the support tower 3 is provided with four horizontal, radially projecting, spaced-apart, main beams 5. Each main beam 5 is supported for reinforcement by a cable 6 having an upper end 6(*a*) secured to the top of the support tower 3 and a lower end 6(*b*) secured to the outboard end 5(*b*) of the main beam 5.

The tower 3 is also provided with a plurality of helically arranged and radially spaced-apart beams 7 shifted from one another in both the height direction and the circumferential direction. Each main beam 5 supports a group of beams 7 arrayed in a common vertical plane beneath beam 5. Beams 7 are coupled at their inner and outer ends 7(*a*) and 7(*b*) to the main beams 5 by suspension cables 8 so that the entire coplanar group of beams 7 is supported by said one main beam 5.

Each main beam 5, and each radial beam 7 to which the tops of the suspension cables 8 are tied, is provided with a suspension adjustment unit 9 consisting of a center hole jack and a cable lock. Beams 7 may be adjusted individually by adjusting the lengths of the suspension cables 8 with the suspension adjustment units 9.

On the beams 7 are supported arcuate floor joists 10, which have predetermined lengths, and connecting end portions 10(*a*) which overlap on the beams 7. The floor joists 10 are in contact with guide elements 11 (not shown) but which are provided on the beams 7 and consist of pins and rollers, so that the joists 10 can be easily shifted relative to the beams 7. Therefore, when making a slope change, as will be described later in detail, a length adjustment of the suspension cables 8 for supporting a particular beam 7 causes a compensating shifting of overlapped end portions 10(*a*) of the floor joists 10 along the guide sections 11.

Formed on the floor support members 10 is a ramp floor 12 upon which a ski surface of artificial snow is produced with snow-making equipment.

Figure 3:
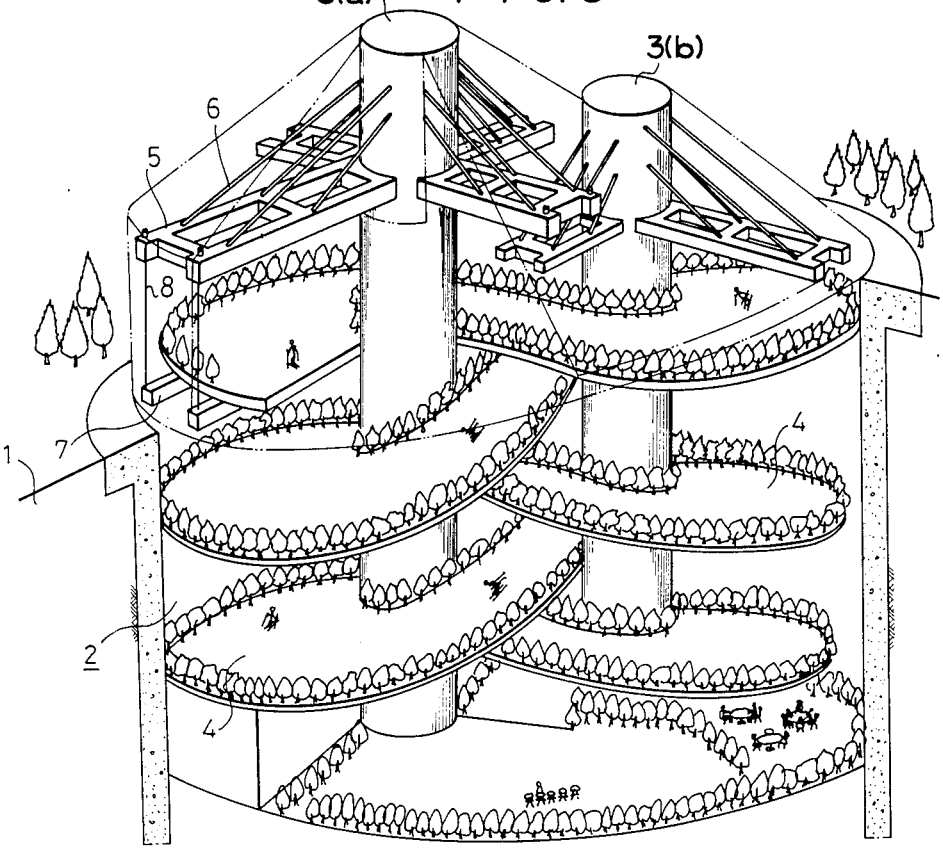
FIG. 3 is a perspective view, partially in section, of another preferred embodiment of the invention showing an indoor skiing coliseum having a figure eight ski ramp suspended from two columnar support towers.
Figure 4:
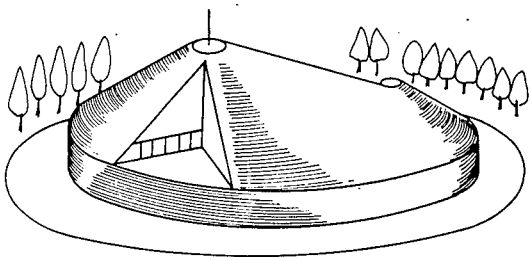
FIG. 4 is a perspective view, partially in section, showing the roof portion of the indoor skiing coliseum shown in FIG. 3.

FIGS. 3 and 4 show a different embodiment of the invention. This indoor skiing coliseum comprises two support towers 3(*a*) and 3(*b*) and a meandering ski running area provided around the two center towers 3(*a*)–3(*b*), in the form of a Figure eight, such that it has sections alternately turning in opposite directions.

In the indoor skiing coliseums described above, the slope adjustment of the ski ramp may be done during construction or after start of the use of the coliseum. For the slope adjustment, the cable lock of the suspension adjustment unit 9 provided at the upper end of the suspension cable 8 for supporting a desired beam 7 is released, and the cable is taken up or paid off. When the desired slope is obtained, the cable is relocked. In this way, the slope adjustment can be easily made for each beam. As aforesaid, the increase or reduction of the length of the ramp due to a slope change is compensated by a relative shifting of the overlapped sections 10(*a*) of the affected floor joist members 10. If the ramp length is changed greatly, the replacement of the ramp 12 may be necessary. To avoid ramp replacement, it is possible to construct the floor 12 using wire nets.

With the above construction of the indoor skiing coliseum, a long ski run can be formed in comparison to the land base upon which the coliseum is erected. Thus, it is possible to provide slopes having different degrees of difficulty of skiing and rich in changes. Further, when the indoor skiing coliseum is constructed underground with the top portion covered with a building, it has excellent thermal insulation properties so that it is possible to reduce the cost of insulation with manufactured insulating materials.

Figure 5:
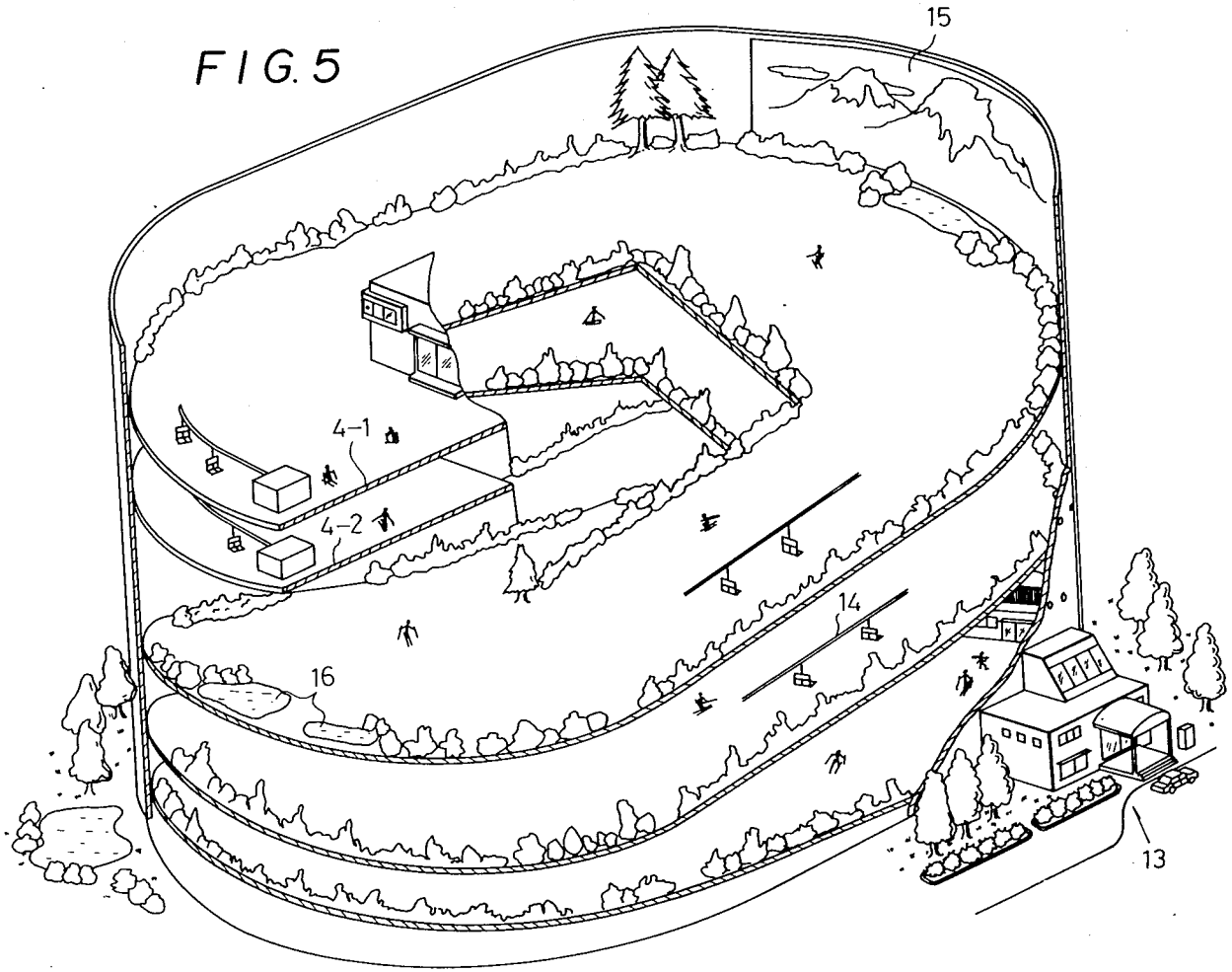
FIG. 5 is a perspective view, partially in section, showing an indoor skiing coliseum having a pair of upper and lower helical ski ramps suspended from a columnar support tower such as shown in FIGS. 1 and 2.

FIG. 5 shows another embodiment of the inventive indoor skiing coliseum, which has both upper and lower, helical ski runs 4-1 and 4-2 of different inclination secured to a center tower (not shown). The ski run 4-1 is for intermediate and expert skiers and has a steeper slope than the slope of the ski run 4-2, which is for novice skiers. A predetermined headroom is maintained between the ski runs 4-1 and 4-2.

The skier enters the coliseum from an entrance 13 and goes up the center tower (not shown) using an elevator to the intermediate and expert ski run area 4-1 or the novice ski run area 4-2 in accordance with his or her own skiing ability.

Further, chair lifts 14 may be provided along the respective ski run areas 4-1 and 4-2 in addition to the elevator in the center tower.

Further, in this indoor skiing coliseum, simulation of natural environment is provided by projecting a scene on a jambo screen 15 provided on a wall and also by providing an artificial pond 16 in part of the ski run area.

Figure 6:
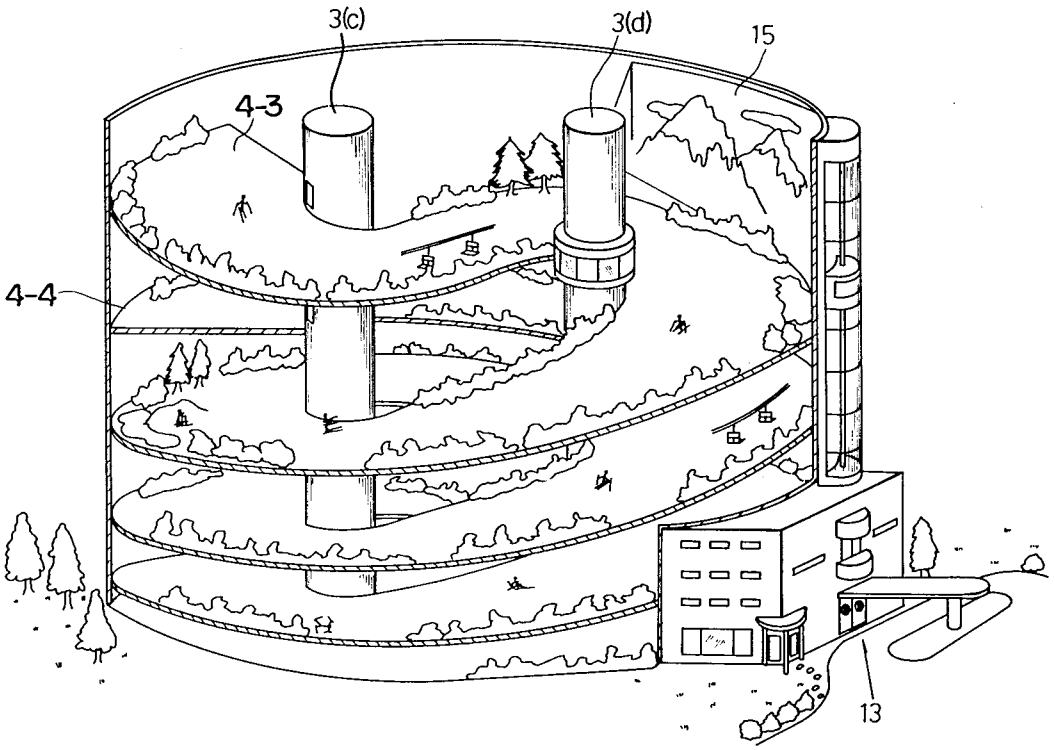
FIG. 6 is a perspective view, partially in section, showing an indoor skiing coliseum having a pair of upper and lower helical ski ramps of different inclination suspended from two columnar support towers.

FIG. 6 shows a still further embodiment of the invention which also has upper and lower, helical ski run areas 4-3 and 4-4 of different inclination provided around two support towers 3(*c*) and 3(*d*). In this embodiment, longer ski runs may be provided than possible in the case of the embodiment of FIG. 5.

Figure 7:
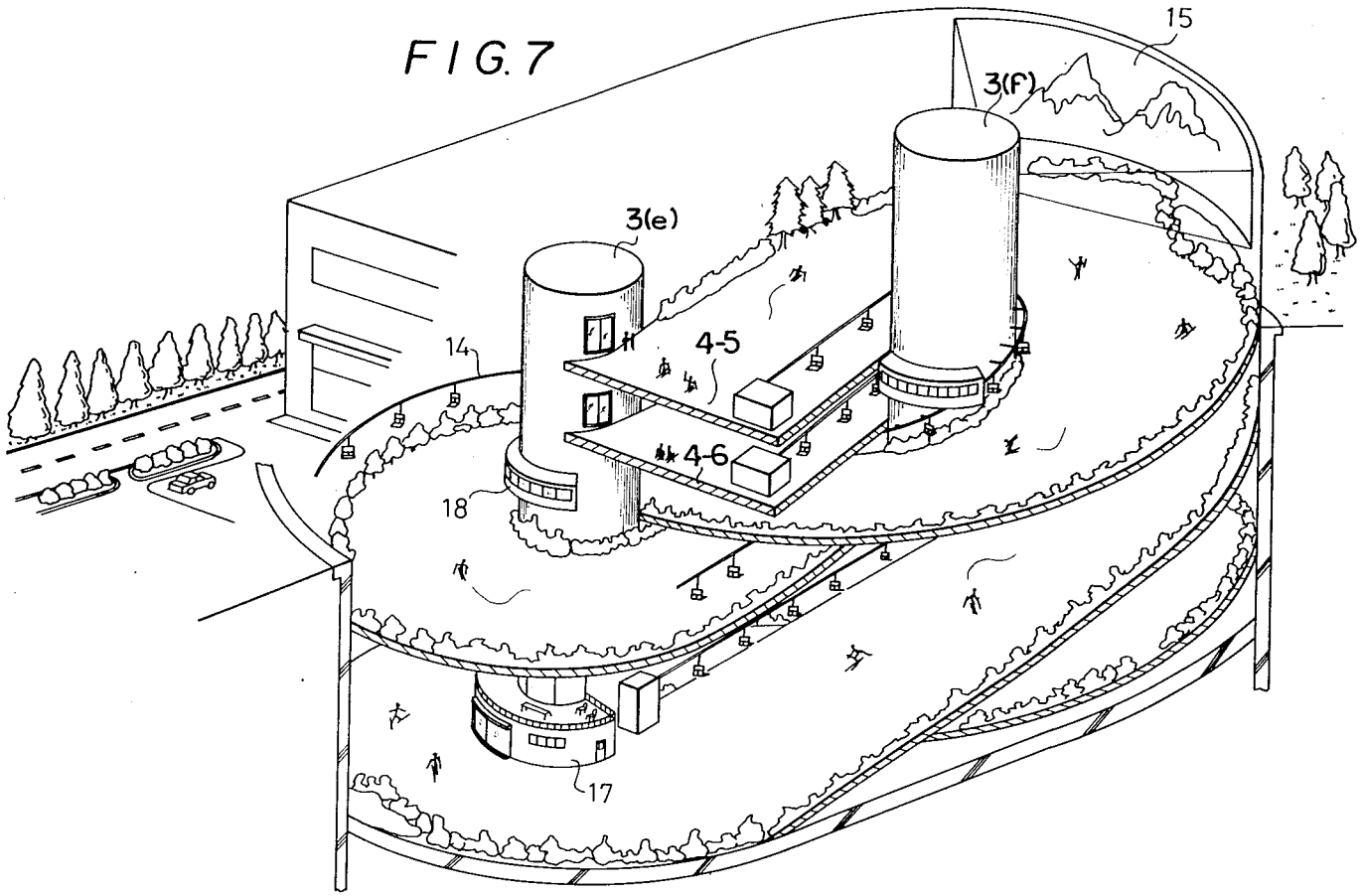
FIG. 7 is a perspective view, partially in section, showing another embodiment of an indoor skiing coliseum having a pair of upper and lower meandering ski ramps of different inclination provided around two columnar support towers.

FIG. 7 shows a yet further embodiment of the invention which has upper and lower, meandering ski run areas 4-5 and 4-6 of different inclinations provided around two support towers 3(*e*) and 3(*f*). On these ski runs, it is possible to form slopes with a variety of contours compared to the slopes of FIG. 6. Further, in this embodiment, the space can be effectively utilized to include a main restaurant 17 and a coffee room 18.

In prior art artificial slopes, usually a layer of artificial snow is produced on a smooth floor, resulting in a slope that is uninteresting to the skier. According to the present invention, it is possible to form mogul areas of different sizes according to the skiing skills of the skiers. The mogul areas are produced by providing between the snow layer and the ski ramp a flexible, inflatable mat in which frozen water is sealed.

Figure 8:
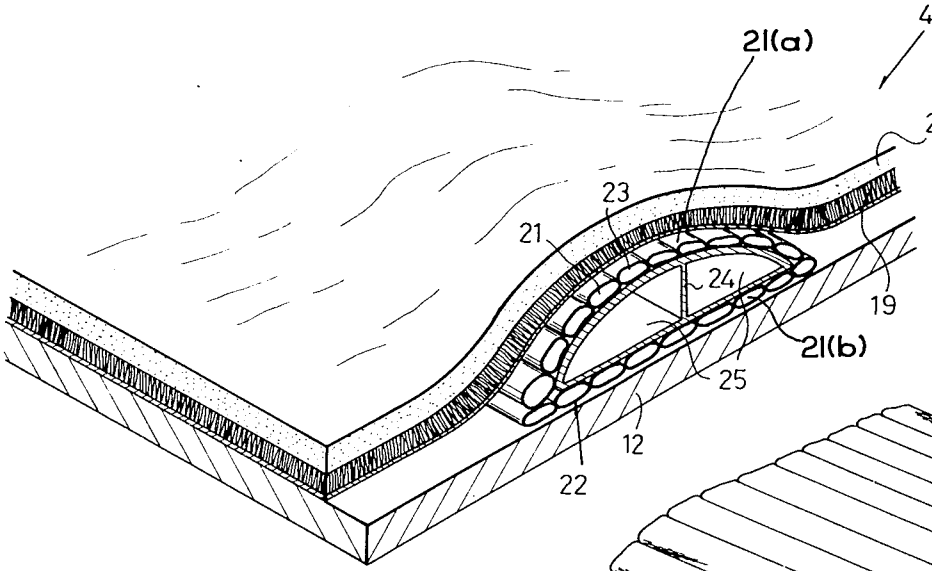
FIG. 8 is a perspective view, partially in section, showing a fluid-mechanical device for producing a simulated mogul on the ski ramps of the preceding figures.

FIG. 8 shows a portion of the ski run area 4 comprising a wooden ramp 12, artificial turf 19 provided thereon, and a surface snow layer 20. A flexible mat 22 is provided between the wooden ramp 12 and the artificial turf 19. The flexible mat 22 has upper and lower water chamber rows 21(*a*) and 21(*b*), respectively, comprising a plurality of side-by-side elongate water chambers 21. A mogul is formed by freezing water 23 pumped into the water chambers 21.

Figure 9:
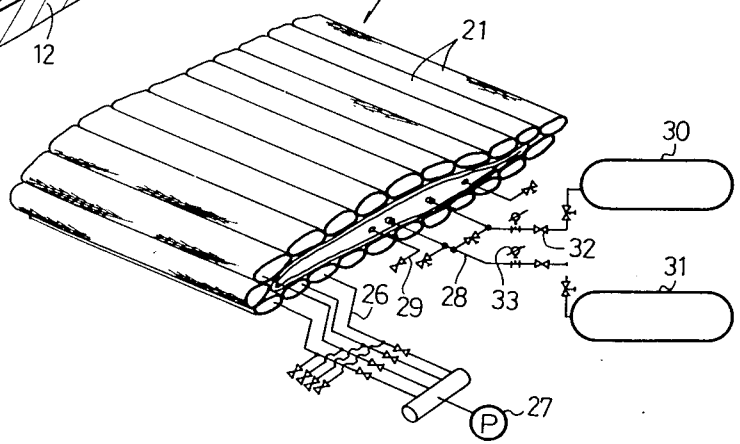
FIG. 9 is a perspective view of means to inflate and to cool the fluid-mechanical means of FIG. 8.

In this flexible mat 22, the upper and lower water chamber rows 21(*a*) and (*b*) define an airtight space 25 which is divided into two spaces by a partitioning wall 24. One end of each water chamber 21 of the mat 22, as shown in FIG. 9, is connected to a pipe 26, through which water is pumped and discharged. The pipe is connected at the other end to a water pump 27. An end of each space 25 is provided with a supply pipe 28 and a discharge pipe 29. The other end of the supply pipe 28 is connected to a hot air tank 30 or cold air tank 31. Reference numeral 32 in FIG. 9 designates valves, and numeral 33 designates pressure gauges.

Figure 10:
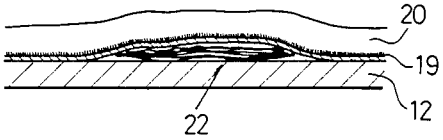
FIG. 10 is an elevational view in section showing a deflated fluid-mechanical device in place on a ski ramp.

When the water chambers 21 and spaces 25 are empty, the flexible mat 22 is deflated, as shown in FIG. 10. In this case, no mogul is formed, and the surface of the snow layer 20 constitutes a flat course.

Figure 11:
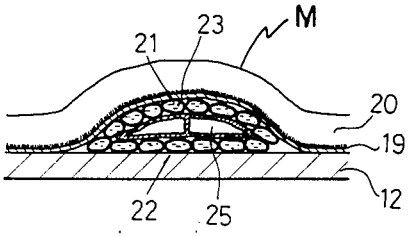
FIG. 11 is an elevational view in section illustrating the fluid-mechanical device of FIG. 8 partially inflated.
Figure 12:
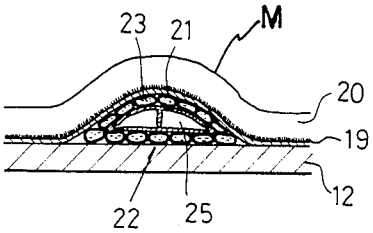
FIG. 12 is an elevational view in section showing the fluid-mechanical device of FIG. 8 more fully inflated.
Figure 13:
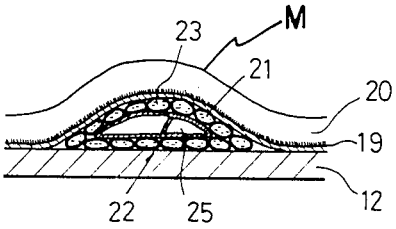
FIG. 13 is an elevational view in section showing the fluid-mechanical device of FIG. 8 inflated in a modified manner.

To produce a mogul M, water is pumped into the water chambers 21 from the water pump 27, while at the same time pressurized air is supplied into the spaces 25, so that the flexible mat is expanded as shown in FIG. 11. Subsequently, cold air (at −6° C.) is supplied into the spaces 25 from the cold air tank 31 to cause freezing of water in the surrounding water chambers 21. In this way, the mogul M shown in FIG. 12 is formed.

Further, the mogul M may be changed with the shape of the flexible mat 22 by reducing the water pressure, by melting ice surrounding the water chambers 21, by replacing cold air in one of the spaces 25 with hot air, or by discharging water from the water chambers 21. Further, various mogul surfaces may be formed as desired with the shape of the mat varied as desired by pumping water into selected ones of the water chambers 21 and freezing it.

For the freezing or expansion of the mat 22, it is possible to use salt water, e.g., an aqueous solution of calcium chloride, in lieu of air. Further, it is possible to cause freezing of the water in the water chambers using the salt water as a cooling medium, by cooling the salt water or melting the ice in the water chambers using the salt water at comparatively high temperature. Further, for the freezing or melting of water in the water chambers, for instance, it is possible to provide meandering piping on the spaces defined by the water chambers and circulate the salt water at lower temperature or at comparatively high temperature through this piping.

Figure 14:
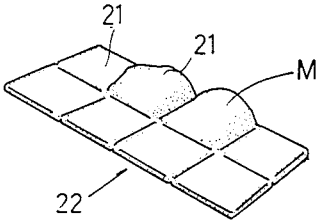
FIG. 14 is a perspective view showing how a mogul field can be formed from a plurality of the fluid-mechanical devices of FIG. 8.

The flexible mat 22 is made of rubber or like material which does not become brittle at low temperature. FIG. 14 shows a plurality of moguls to form a mogul field, wherein the water chambers 21 are arranged in a lattice-like form. In this case, irregular moguls may be formed by causing expansion of selected water chambers by supplying water under pressure and freezing the supplied water.

The artificial snow used for the artificial skiing place is usually produced by spraying water under high pressure from a porous nozzle into air at −6° C. or below, and thereby freezing the sprayed water. In this method, however, latent heat is generated when the water is frozen. Therefore, in order to maintain a predetermined freezing temperature, it is necessary to supply the cold corresponding to the latent heat.

Usually, the artificial snow production in the indoor skiing coliseum is done at night, after the end of the skiing activity. For the snow production, it is necessary to lower the ambient air temperature to a freezing temperature of about −6° C. Heretofore, for artificial snow production, the entire enclosed atmosphere of the coliseum was lowered and then held at a freezing temperature. At this temperature, water was then sprayed from four or five snow-making machines slowly moving along the ski ramp to form artificial snow over the entire ski ramp. In this prior art method, it is necessary to hold a large volume of air at freezing temperature for a long time. This is a very inefficient way to make snow.

According to the present invention, the artificial snow is produced very efficiently compared to the prior art method. In the method of making artificial snow according to the present invention, water is sprayed in atomized form into a small thermally insulated enclosure the atmosphere of which has been pre-chilled and is maintained at a water freezing temperature. This enclosure is cubical in shape, having a top and four sides but no bottom, the ski ramp serving the function of a bottom so as to define a fully confined enclosure. The enclosure extends from side to side of the ski ramp and is adapted to be moved along the ski ramp, depositing snow thereon with snow-making machines placed within the enclosure.

A preferred embodiment of the artificial snow-making mechanism will now be described in specific detail.

Figure 15:
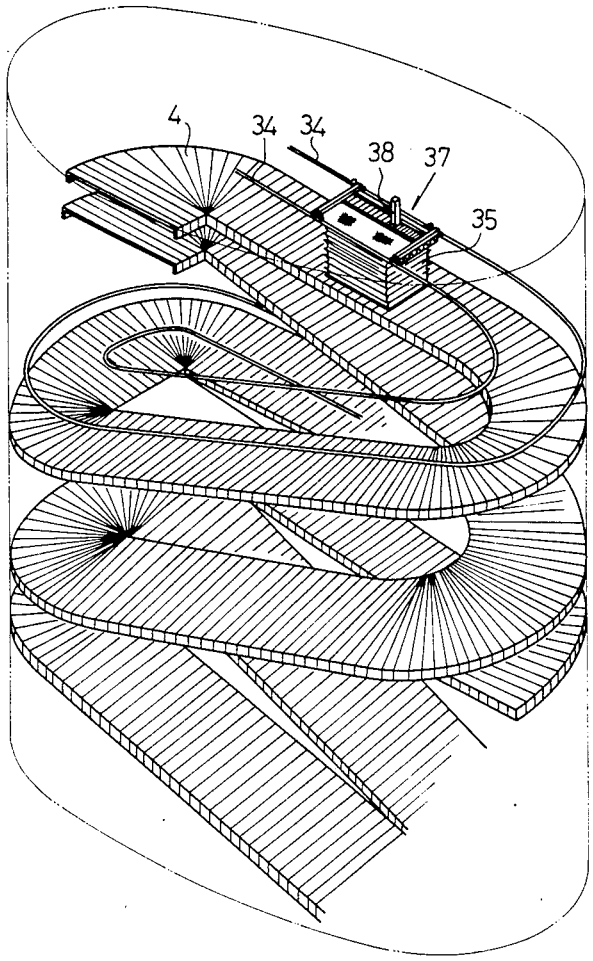
FIG. 15 is a perspective view of a ski ramp in accordance with the invention and an artificial snow-making module track mounted to move along the path of the ramp.
Figure 16:
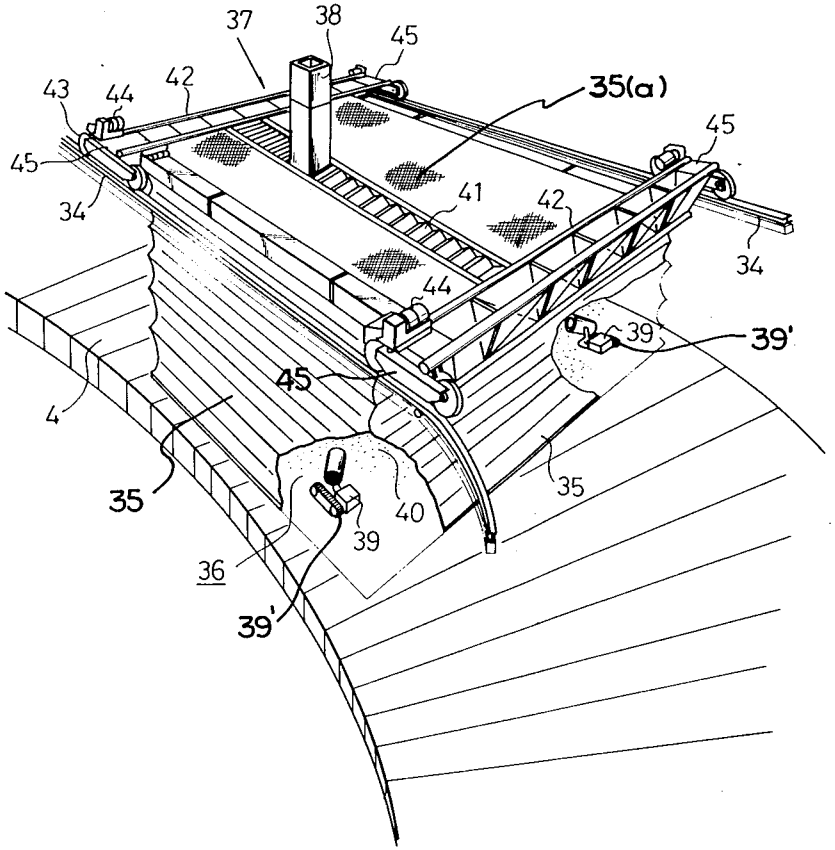
FIG. 16 is a partial fragmentary view in perspective of the snow-making module first shown in FIG. 15.

Referring to FIG. 15, there is shown a helical ski ramp 4 having guide rails 34 positioned on opposite sides. To produce artificial snow, a thermally insulated module 37 is mounted on the guide rails 34 and is capable of being guided by the rails 34 to run along the ski ramp 4. The module 37 (see FIG. 16) encloses a substantially rectangular space 36 by means of side curtains 35 and a top 35(*a*). In a preferred embodiment, the module has a width of 25 m., a length of 30 m. and a height of 10 m. Without changing the temperature of the atmosphere in the coliseum, cold air at −6° C. is supplied from a duct 38 into the space 36 within the thermally insulated module 37. At the same time, atomized water 40 is sprayed from a self-powered and mobile snow-making machine 39 in the space 36. In this way, the artificial snow is produced. The snow-making machine 39 and thermally insulated module 37 are moved down the ski ramp at the same speed while the artificial snow is being made. The duct 38 is shiftable relative to the top 35(*a*) of the module 37 by means of bellows 41. Its position thus can be changed as desired to provide satisfactory interaction between cold air and atomized water. A plurality of thermally insulated modules 37 may be provided as required.

The thermally insulated screens 35 providing the sides for the module 37 are pleated in order to be vertically adjustable so as to approximately accommodate to the irregularities of the ramp 4. Running frames 42 are provided at the top front and top rear of the module 37. Mounted on the outboard ends of the frames are bogey wheel assemblies 45, each having wheels 43 and drive motors 44 (see FIG. 16).

Figure 17:
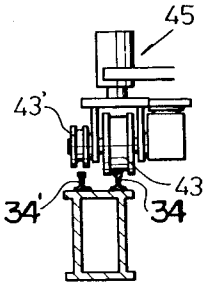
FIG. 17 is an elevational view in section showing one of the bogey wheel assemblies which support the snow-making module on its supporting track during straight-away movement on the track.
Figure 18:
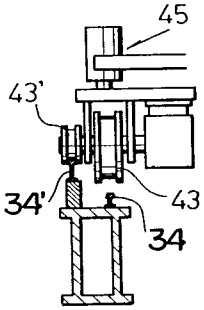
FIG. 18 is an elevational view in section showing the bogey wheel assembly of FIG. 17 negotiating a curved portion of the track.
Figure 19:
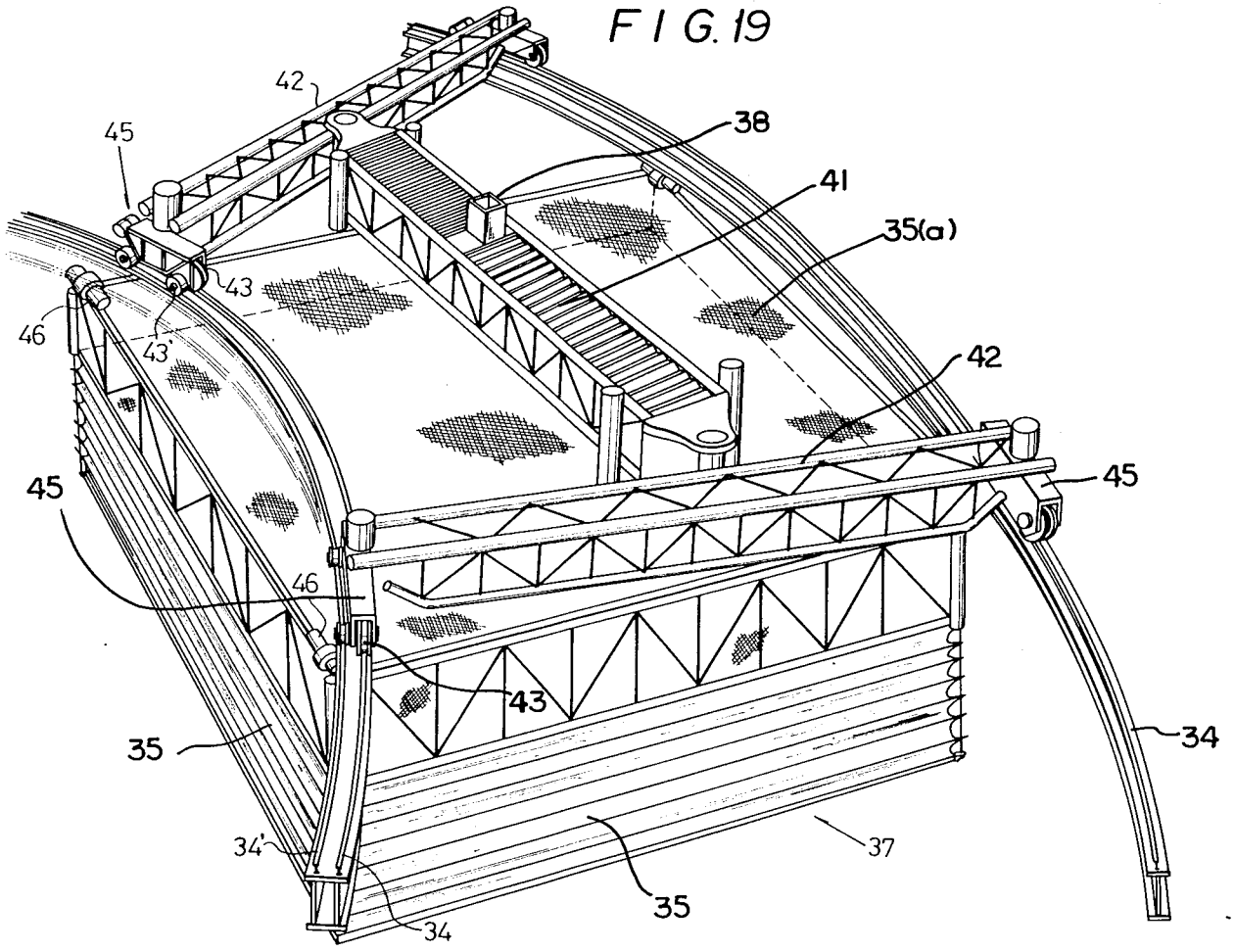
FIG. 19 is another perspective view of the module shown in FIG. 16 illustrating the module bogey wheel assemblies negotiating a curved portion of the module supporting track.

Referring now to FIGS. 17, 18, and 19, it will be seen that the wheels 43 are mounted to roll on rails 34. A small wheel cam rail 34' is provided on the outer side of and parallel to the inner one of curved rails 34. Immediately before the apparatus comes to the curved rail portions, it is running with the wheels 43 on the rails 34, as shown in FIG. 17. As the curved rail portions are approached, the height of the small wheel rail 34' is gradually increased. When the curved portions of the rails are reached, small wheels 43' provided coaxially on the outer side of the inner side wheels 43 come to ride up on the cam rail 34' to thereby provide the bogey wheel assembly with a sharper turning radius capability. In FIG. 19, reference numeral 46 designates winches for raising and lowering the pleated thermal insulation screens 35.

Cold air is supplied to the thermally insulated module 37 through duct 38. When the temperature in the module 37 is lowered to about −6° C., snow-making machines 39 are then placed in operation by spraying atomized water within the confines of the module. Simultaneously, module 37, by means of its motorized bogey wheel assemblies 45, and snow-making machines 39, by means of their self-propelling endless tracks 39', move down the ski ramp 12, covering the ramp with a layer of artificial snow.

It will be understood that the above-described embodiments of the invention are for the purpose of illustration only. Additional embodiments, modifications, and improvements can be readily anticipated by those skilled in the art based on a reading and study of the present disclosure. Such additional embodiments, modifications, and improvements may be fairly presumed to be within the spirit, scope, and purview of the invention as defined by the subtended claims.

What is claimed is:

1. An indoor skiing facility comprising: a vertical support tower; a helical ski ramp positioned around and supported by said support tower; a plurality of main beams radially extending from the top of said support tower; a plurality of ramp joist support beams in vertically aligned groups radially extending from and helically configured about the periphery of said support tower; each of said groups being aligned beneath a corresponding main beam; suspension cable means interconnecting each group of ramp joist support beams to a corresponding main beam; and said suspension cables being provided with means for adjusting the distance between said ramp joist support beams and the distance between said corresponding main beam and the said ramp joist support beams.

2. An indoor skiing facility comprising: a vertical support tower; a helical ski ramp positioned around and supported by said support tower, and including artificial turf on said ski ramp and a flexible inflatable mat positioned between said ski ramp and said artificial turf.

3. The device of claim 2, wherein said mat has a plurality of fluid chambers, and means to selectively inflate said fluid chambers.

4. The device of claim 2, wherein said flexible mat has a plurality of water chambers, and means to selectively inflate said water chambers.

5. The device of claim 2, wherein said mat has a plurality of air chambers, and means to selectively inflate said air chambers.

6. The device of claim 2, wherein said mat includes: a plurality of air chambers; means to selectively inflate said air chambers; a plurality of water chambers; means to selectively inflate said water chambers; means to freeze and to defrost water in said water chambers; and means to adjustably control the inflation of said air and of said water chambers.

7. The device of claim 6, including a plurality of separately and selectively inflatable mats.

8. An indoor skiing facility comprising a thermally insulated superstructure; a support tower vertically positioned within said superstructure; elevator means within said support tower; a plurality of main support structural members secured to the top of said support tower and extending radially therefrom; a plurality of ramp support beams radially extending from and helically arrayed about said support tower; a plurality of curved ski ramp joists helically arrayed about said support tower to rest upon said ramp support beams in consecutive helical alignment to provide overlap between helically aligned joists; means to maintain said joists in shiftable overlapped alignment; means to vertically shift said ramp support beams to selectively change the inclination of selected ski ramp joists; and means to sheath said ski ramp joists to provide a ramp to support a layer of artificial snow.

9. The device of claim 8, wherein said means to vertically shift said ramp support beams comprises suspension cables interconnecting a main support beam to a lower ramp support beam and said lower ramp support beam to a next lower ramp support beam; means to selectively adjust the lengths of said cables; and means to lock said cables following a selected adjustment in length.

10. The device of claim 8, including a second support tower; and said ramp support beams being arrayed about said first and second towers to support a plurality of descending figure eight interconnecting ramp configurations.

11. The device of claim 8, including a second ramp helically sandwiched between the helical turns of said first-mentioned ramp, said ramps being of different non-interfering inclination.

12. The device of claim 8, wherein said facility is erected in an excavation and then back-filled.

13. The device of claim 8, wherein said facility is erected at ground level.

14. The device of claim 8, wherein the interior of said facility is decorated with photographic projections on the interior walls thereof.

15. The device of claim 8, including a mogul-simulating inflatable mat superposed on said base; and a layer of artificial turf superposed on said mat.

16. The device of claim 8, including a self-propelled, thermally insulated module adapted to be track-conveyed along said ramp; means to cool the interior of said module to snow-making temperature; and self-propelled means to spray atomized water in the interior of said module to produce snow.

17. The device of claim 16, including a cold air duct adapted to air-condition the interior of said module, and means to permit shifting of said duct responsive to movement of said module.

18. The device of claim 16, wherein said module comprises a top and four rectangularly arrayed, horizontally pleated side walls, whereby snow made within said module is free to fall on said ramp.

19. The device of claim 18, including motor means to selectively raise and lower said side walls.

20. The device of claim 18, wherein said module is supported at the intersections of its side walls with self-powered bogey wheel assemblies having wheels adapted to run on tracks.

21. The device of claim 20, including bogey wheel supporting track means on opposite sides of said ramp, said track means comprising exterior and interior tracks, and intermittent track cam means adjacent to and elevated above the top surface of said interior track; the bogey wheel assembly riding on said interior track, including a wheel of major diameter; a coaxial wheel of minor diameter; said wheel of major diameter being adapted to ride on said interior track and said wheel of minor diameter being adapted to engage and to ride on said intermittent track cam to vertically shift said wheel of major diameter on and off said interior track, whereby the turning radius of said bogey wheel assembly is increased when said wheel of major diameter is clear of said interior track.

22. The device of claim 20, wherein bogey wheel assemblies are supported at opposite ends of first and second structural bridge members extending transversely across the front and back ends of said module; a third structural bridge member extending between and pivotally secured to the interior interior midsections of said first and second structural bridge members; and means to secure said module to said third bridge member, whereby said bogey wheel assemblies are adapted to run on curved portions of track means without stressing said module.

23. An indoor skiing facility comprising a vertical support tower; a ramp positioned around and supported by said support tower; tracks on opposite sides of said ramp and extending parallel with said ramp; a self-propelled snow-making module adapted to be selectively propelled on said tracks, said module comprising a top member and side members; means to cool the interior of said module; means to make artificial snow in the cooled interior of said module; means to adjust said side members to the contour of said ramp; and means to permit said module to move along a curved portion of said tracks without stressing said module.

24. An indoor skiing facility comprising: a vertical support tower; a helical ski ramp positioned about said vertical support tower; a thermally insulated containment building encasing said vertical support tower and said helical ski ramp; and means to transport skiiers from the base to the top of said helical ski ramp.

25. The indoor skiing facility of claim 24, including artificial turf on said ski ramp adapted to provide a base for artificial snow.

26. The indoor skiing facility of claim 25, including means to simulate moguls interposed between said ski ramp and said artificial turf.

27. The indoor skiing facility of claim 24 including movable means adapted to enclose a discrete space above said helical ski ramp and means to cool said space sufficient to enable the manufacture of artificial snow within said discrete space.

28. The indoor skiing facility of claim 24, including means to selectively vary the slope at selected portions of said helical ski ramp.

29. The device of claim 31, including a second helical ski ramp forming a double helix with said first helical ski ramp and supported by said vertical support tower.

30. The device of claim 29, including means to selectively vary the slope of selected portions of said second helical ski ramp.

31. The indoor skiing facility of claim 24, including a second vertical support tower and said helical ski ramp being adapted to be positioned about and supported by both of said support towers.

32. The device of claim 31, including a second helical ski ramp forming a double helix with said first helical ski ramp and supported by both of said support towers.

33. The device of claim 32, including means to selectively vary the slope at selected portions of said first and second helical ski ramps.

* * * * *

UNITED STATES PATENT AND TRADEMARK OFFICE

CERTIFICATE OF CORRECTION

PATENT NO. : 4,790,531

DATED : Dec. 13, 1988

INVENTOR(S) : Matsui et al.

It is certified that error appears in the above—identified patent and that said Letters Patent is hereby corrected as shown below:

Column 10, line 43, Claim 29, delete "31" and insert --24--.

Signed and Sealed this

Ninth Day of January, 1990

*Attest:*

JEFFREY M. SAMUELS

*Attesting Officer*

*Acting Commissioner of Patents and Trademarks*